US012226826B2

(12) United States Patent
Lu et al.

(10) Patent No.: US 12,226,826 B2
(45) Date of Patent: Feb. 18, 2025

(54) HIGH-STRENGTH AND HIGH-PLASTICITY TITANIUM MATRIX COMPOSITE AND PREPARATION METHOD THEREOF

(71) Applicant: University of Science and Technology Beijing, Beijing (CN)

(72) Inventors: Xin Lu, Beijing (CN); Yu Pan, Beijing (CN); Yucheng Yang, Beijing (CN); Jiazhen Zhang, Beijing (CN); Wei Xu, Beijing (CN); Bowen Liu, Beijing (CN); Ce Zhang, Beijing (CN); Jianzhuo Sun, Beijing (CN); Yanjun Liu, Beijing (CN); Xuanhui Qu, Beijing (CN)

(73) Assignee: UNIVERSITY OF SCIENCE AND TECHNOLOGY BEIJING, Beijing (CN)

( * ) Notice: Subject to any disclaimer, the term of this patent is extended or adjusted under 35 U.S.C. 154(b) by 457 days.

(21) Appl. No.: 17/768,737

(22) PCT Filed: Aug. 17, 2020

(86) PCT No.: PCT/CN2020/109487

§ 371 (c)(1),
(2) Date: Apr. 13, 2022

(87) PCT Pub. No.: WO2022/021488

PCT Pub. Date: Feb. 3, 2022

(65) Prior Publication Data

US 2023/0191482 A1 Jun. 22, 2023

(30) Foreign Application Priority Data

Jul. 29, 2020 (CN) ..... 202010745078.1

(51) Int. Cl.
*B22F 3/10* (2006.01)
*B22F 1/05* (2022.01)
(Continued)

(52) U.S. Cl.
CPC ..... *B22F 3/1007* (2013.01); *B22F 1/05* (2022.01); *B22F 1/12* (2022.01); *B22F 9/04* (2013.01);
(Continued)

(58) Field of Classification Search
CPC .. B22F 3/1007; B22F 1/12; B22F 1/05; B22F 9/04; B22F 2009/043; B22F 2009/049;
(Continued)

(56) References Cited

U.S. PATENT DOCUMENTS

2012/0276393 A1* 11/2012 Lee ..... C22C 1/1068 156/308.2
2018/0354032 A1 12/2018 Motchenbacher et al.
2020/0215606 A1 7/2020 Barnes et al.

FOREIGN PATENT DOCUMENTS

CN 103572084 A 2/2014
CN 105734316 A 7/2016
CN 108080621 A 5/2018
CN 108193064 A 6/2018
CN 109848406 A 6/2019
CN 109971982 A 7/2019
CN 109988940 A 7/2019
CN 111151762 A 5/2020

OTHER PUBLICATIONS

International Search Report dated Apr. 27, 2021 received in International Application No. PCT/CN2020/109487.

* cited by examiner

*Primary Examiner* — Ricardo D Morales
(74) *Attorney, Agent, or Firm* — Scully, Scott, Murphy & Presser, P.C.

(57) ABSTRACT

The present invention provides a high-strength and high-plasticity titanium matrix composite and a preparation
(Continued)

method thereof. The preparation method includes: preparing high-oxygen hydride-dehydride titanium powder using a high-temperature rotary ball grinding treatment process, in which the prepared hydride-dehydride titanium powder has a particle size of 10-40 μm, and has an oxygen content of 0.8-1.5 wt. %; preparing high-purity ultra-fine oxygen adsorbent powder using a wet grinding method of high-energy vibration ball grinding treatment process; in which a purity of the oxygen adsorbent powder is ≥99.9%, and a particle size of the oxygen adsorbent powder is ≤8 μm; mixing the high-oxygen hydride-dehydride titanium powder with the oxygen adsorbent powder in a protective atmosphere, and then press-forming the powder obtained after mixing to obtain a raw material blank; and performing atmosphere protective sintering treatment on the raw material blank to obtain a titanium matrix composite. The method prepares a titanium matrix composite reinforced by in-situ self-generating multi-scale Ca—Ti—O, TiC, TiB particles. The microstructure and grains are effectively refined, and the strength and plasticity of the material are significantly improved.

14 Claims, 2 Drawing Sheets

(51) Int. Cl.
*B22F 1/12* (2022.01)
*B22F 9/04* (2006.01)

(52) U.S. Cl.
CPC ... *B22F 2009/043* (2013.01); *B22F 2009/049* (2013.01); *B22F 2201/11* (2013.01); *B22F 2203/11* (2013.01); *B22F 2301/205* (2013.01); *B22F 2303/45* (2013.01)

(58) Field of Classification Search
CPC ..... B22F 2201/11; B22F 2203/11; B22F 2301/205; B22F 2303/45
See application file for complete search history.

HIGH-STRENGTH AND HIGH-PLASTICITY TITANIUM MATRIX COMPOSITE AND PREPARATION METHOD THEREOF

TECHNICAL FIELD

The present invention relates to the technical field of powder metallurgy, and in particular to a high-strength and high-plasticity titanium matrix composite and a preparation method thereof.

BACKGROUND

With the development of modern manufacturing industry, metal matrix composites have become an indispensable new type of material to support the development of the most advanced science and technology. As a "noble member" of the big family of metal matrix composites, titanium matrix composites, due to their potential properties of high strength, high toughness and heat resistance, are highly favored in high-tech industries such as aerospace and weaponry which are of national strategic significance. Among the many preparation processes of titanium matrix composites, the in-situ self-generating technology of powder metallurgy has unique advantages in terms of optimization design of the structure and function and performance regulation of the material, thereby meeting the requirements of high-end products on material diversification, light weight and rapid development, and effectively realizing the near-net-shape preparation of high-performance titanium matrix composites.

Interstitial oxygen is an important impurity and alloy element of powdery titanium parts, and it greatly affects the microstructure and mechanical properties of the material. However, it is very difficult for the traditional preparation process to obtain titanium matrix composites with low preparation cost and high strength and plasticity at the same time.

In summary, in order to realize low-cost hydride-dehydride (HDH) titanium powder is applied to the near-net-shape preparation of high-strength and high-plasticity titanium matrix composites, a method for preparing a high-oxygen HDH titanium powder, a high-purity ultra-fine $CaC_2/CaB_6$ powder and a high-strength and high-plasticity titanium matrix composite thereof is developed, which can greatly improve the mechanical properties of titanium parts while maintaining the low cost advantage of HDH titanium powder.

SUMMARY

A main object of the present invention is to provide a high-strength and high-plasticity titanium matrix composite and a preparation method thereof. In the method for preparing the high-strength and high-plasticity titanium matrix composite, low-cost HDH titanium powder is used as raw material; firstly, high-oxygen HDH titanium powder is prepared by a high-temperature rotary ball grinding method; then, high-purity ultra-fine $CaC_2/CaB_6$ powder is prepared by a wet grinding method of high-energy vibration ball grinding; and subsequently, a powder metallurgy forming and sintering process is used to prepare a titanium matrix composite reinforced by in-situ self-generating multi-scale Ca—Ti—O, TiC, TiB particles. The microstructure and grains are effectively refined, and the strength and plasticity of the material are significantly improved, so as to solve the technical problem of high preparation cost of high-strength and high-plasticity titanium matrix composites in the prior art.

In order to achieve the above object, according to a first aspect of the present invention, a method for preparing a high-strength and high-plasticity titanium matrix composite is provided.

The method for preparing the high-strength and high-plasticity titanium matrix composite includes the following steps:

S1: preparing high-oxygen hydride-dehydride titanium powder using a high-temperature rotary ball grinding treatment process, in which the prepared hydride-dehydride titanium powder has a particle size of 10-40 μm, and has an oxygen content of 0.8-1.5 wt. %;

S2: preparing high-purity ultra-fine oxygen adsorbent powder using a wet grinding method of high-energy vibration ball grinding treatment process; in which a purity of the oxygen adsorbent powder is ≥99.9%, and a particle size of the oxygen adsorbent powder is ≤8 μm; and the oxygen adsorbent is selected from at least one of $CaC_2$ and $CaB_6$;

S3: preparing a raw material blank, in which the high-oxygen hydride-dehydride titanium powder is mixed with the high-purity ultra-fine $CaC_2/CaB_6$ powder in a protective atmosphere, and then the powder obtained after mixing is press-formed to obtain a crude material blank;

S4: sintering, in which the raw material blank obtained in step S3 is subjected to atmosphere protective sintering treatment to obtain a titanium matrix composite.

Further, in step S1, the high-temperature rotary ball grinding treatment process includes:

S1-1: putting the hydride-dehydride titanium powder and grinding balls into a protective atmosphere furnace;

S1-2: performing high-temperature rotary ball grinding treatment on the hydride-dehydride titanium powder in the protective atmosphere furnace, in which a rotational speed of rotary ball grinding in this step is 10-60 r/min; and S1-3: cooling the hydride-dehydride titanium powder treated in step S1-2 to room temperature, and sieving to obtain high-oxygen hydride-dehydride titanium powder.

Further, in step S1-1, the hydride-dehydride titanium powder has a median diameter D50 of the particle size of 15-50 μm, and has an oxygen content of ≤0.30 wt. %.

Preferably, the grinding balls are zirconia with a particle size of 6-8 mm; and a mass ratio of the grinding balls to the hydride-dehydride titanium powder is preferably 0.5-2:1.

Further, in step S1-2, the high-temperature rotary ball grinding treatment includes two stages; in a first treatment stage, the temperature is increased to 140-200° C. at a rate of 5-10° C./min in a mixed atmosphere of argon gas and oxygen gas with an oxygen volume fraction of 10-30 vol. %, and the temperature is held for 0.5-3 h; and in a second treatment stage, the temperature is increased to 450-600° C. at a rate of 5-10° C./min in an atmosphere of high-purity argon gas, and the temperature is held for 0.5-3 h.

Further, in step S2, the wet grinding method of high-energy vibration ball grinding treatment process includes:

S2-1: loading the oxygen adsorbent raw material and zirconia grinding balls into a ball grinding tank in a protective atmosphere, adding a protective liquid to the ball grinding tank, and then sealing the ball grinding tank;

S2-2: loading the sealed ball grinding tank into a high-energy vibration ball grinding mill for wet grinding to obtain an oxygen adsorbent slurry; and S2-3: taking out the oxygen adsorbent slurry obtained after wet grinding under a protective atmosphere condition or vacuum condition, drying it at 40-60° C. for 1-4 h, and then sieving to obtain high-purity ultra-fine oxygen adsorbent powder.

Further, in step S2-1, a ball-to-material ratio of the zirconia grinding balls to the oxygen adsorbent raw material is 5-10:1; a diameter of the bulk $CaC_2/CaB_6$ raw material is 50-80 mm; and the protective liquid is an anhydrous and oxygen-free volatile organic solvent.

Further, the surface of the bulk $CaC_2/CaB_6$ raw material is cut and ground by using a small grinding device in a protective atmosphere glove box, so as to remove a surface deteriorated portion.

Further, the anhydrous and oxygen-free volatile organic solvent is at least one of aromatic hydrocarbons, aliphatic hydrocarbons, alicyclic hydrocarbons or halogenated hydrocarbons.

Further, the aromatic hydrocarbons include at least one of benzene, toluene and xylene.

Further, the aliphatic hydrocarbons include at least one of n-pentane, n-hexane, n-heptane and n-octane.

Further, the alicyclic hydrocarbons include cyclohexane; and the halogenated hydrocarbons include at least one of dichloromethane and trichlormethane.

Further, in step S2-2, a vibration frequency of the wet grinding is 1000-1400 times/min, and the wet grinding is performed for 3-6 h according to the ball grinding mode of ball grinding for 2-4 min and shutdown for 4-8 min.

Further, in step S3, a mass fraction percentage of the oxygen adsorbent powder during mixing is 0.4-2.0 wt. %; and the mixing is preferably carried out on a mechanical mixer, in which a rotational speed of the mixer is preferably 60-100 r/min, and the time is preferably 4-8 h.

Further, in step S4, a sintering temperature of the sintering treatment is 1100-1300° C., a heating rate is 2-8° C./min, and a temperature-holding time is 30-180 min.

In order to achieve the above object, according to a second aspect of the present invention, a high-strength and high-plasticity titanium matrix composite is provided.

The high-strength and high-plasticity titanium matrix composite is prepared by the above preparation method, and the titanium matrix composite has a micro-fine equiaxed grain microstructure, with a grain size being 20-100 μm.

Further, a granular Ca—Ti—O reinforcing phase and TiC, TiB reinforcing phase are generated in-situ in the titanium matrix composite, with a particle size of the Ca—Ti—O reinforcing phase being 100-300 nm, and a particle size of the TiC, TiB reinforcing phase being 1-5 μm.

As an important impurity interstitial element, oxygen determines the strength and plasticity of titanium alloy. As the oxygen content increases, the strength of the titanium alloy will increase, but the plasticity will continue to decrease. Once the critical oxygen tolerance content (0.32 wt. %) is exceeded, the plasticity will drop sharply or even brittle fracture might happen. In order to solve the problem that the strength and plasticity cannot be achieved simultaneously, it is necessary to add an appropriate amount of oxygen scavenger to titanium, which can not only reduce the oxygen content in the matrix, but also can generate reinforcing-phase particles to play a role of dispersion strengthening, so that the titanium matrix composite has both good strength and plasticity. In the present invention, a new type of high-purity ultra-fine $CaC_2/CaB_6$ oxygen adsorbent is designed, which can efficiently absorb oxygen before the surface oxygen diffuses and dissolves, inhibits the dissolving of oxide film to the matrix, and ensures the excellent plasticity and toughness of the matrix; at the same time, the interstitial oxygen is adsorbed and fixed to the surface of powder particles, the matrix lattice is purified, and Ca—Ti—O and TiC, TiB reinforcing-phase particles are generated in situ, which plays a key role in improving the strength and hardness of titanium parts. TiC and TiB are known as one of the most ideal reinforcing phases for titanium matrix composites due to their high strength and hardness, excellent wear resistance, thermal expansion coefficient similar to that of Ti matrix, and also good compatibility with Ti matrix, etc. On one hand, the nano Ca—Ti—O particles can refine the grain size of the matrix and play a role of grain refining and strengthening; on the other hand, the nano Ca—Ti—O particles can be dispersed in the titanium matrix, hinder dislocation movement in the matrix, improve the instantaneous strength, creep strength and high temperature strength of the composite material, so that the titanium matrix composite has excellent comprehensive mechanical properties.

The preparation of the high-oxygen HDH titanium powder and the high-purity ultra-fine $CaC_2/CaB_6$ oxygen adsorbent designed by the present invention is the basis for increasing the content of multi-scale Ca—Ti—O, TiC, TiB reinforcing-phase particles. The high-oxygen HDH titanium powder can control the actual oxygen content in the titanium powder by changing the volume fraction of oxygen gas in the mixed gas, and it is ensured that the oxygen is evenly distributed on the surface of the HDH titanium powder through the process of rotating ball grinding and temperature holding at high temperature. Based on anhydrous and oxygen-free solution isolation and high-purity argon gas protection and isolation, the wet grinding method of high-energy vibration ball grinding process is used to inhibit the deliquescence and deterioration of $CaC_2/CaB_6$ during the preparation process, and the preparation of high-purity ultra-fine $CaC_2/CaB_6$ powder is realized. In the process of preparing the titanium matrix composite, the addition amount of $CaC_2/CaB_6$ is 0.4-2.0 wt. %. If the addition amount is too large, it will be difficult for the $CaC_2/CaB_6$ to completely react with the oxygen in the matrix, so that agglomeration is caused, which will deteriorate the performance of the material; and if the addition amount is too small, the effect of adsorbing and fixing oxygen and improving mechanical properties cannot be achieved. Experiments have confirmed that this process can obtain high-strength and high-plasticity titanium matrix composites with uniform distribution of reinforcing phases, fine grains, uniform microstructure and excellent performances.

The present invention has the following technical effects.

(1) The preparation of high-oxygen HDH titanium powder is effectively realized through high-temperature rotary ball grinding, and the oxygen content is in a range of 0.8-1.5 wt. % (the oxygen content of traditional HDH titanium powder is 0-0.4 wt. %) to ensure uniform distribution of interstitial oxygen on the surface of titanium powder.

(2) The wet grinding method of high-energy vibration ball grinding technology is used to avoid deliquescence and deterioration of high-activity $CaC_2/CaB_6$ in direct contact with air during the grinding process, so that the preparation of high-purity ultra-fine $CaC_2/CaB_6$ powder is realized.

(3) The high-purity ultra-fine $CaC_2/CaB_6$ oxygen adsorbent is easy to react with the oxygen in the high-oxygen HDH titanium powder, and at the same time the matrix is purified, a large number of multi-scale Ca—Ti—O and TiC, TiB reinforcing-phase particles are generated in situ, which greatly improves the strength, hardness, plasticity and toughness of titanium matrix composite.

(4) The synergistic effect of oxygen adsorption and fixation and particle reinforcement enables the successful application of low-cost HDH powder raw material to the preparation of high-performance titanium matrix composite, and can reduce the raw material cost of titanium part by 90% and realize low-cost and near-net-shape preparation of high-strength and high-plasticity titanium matrix composite.

BRIEF DESCRIPTION OF THE DRAWINGS

Upon reading the detailed description of preferred embodiments below, various other advantages and benefits will become clear to those skilled in the art. The drawings are only used for the purpose of illustrating the preferred embodiments, and should not be considered as a limitation to the present invention. Moreover, throughout the drawings, identical components are denoted by identical reference signs. In the drawings.

DETAILED DESCRIPTION

Figure 1:
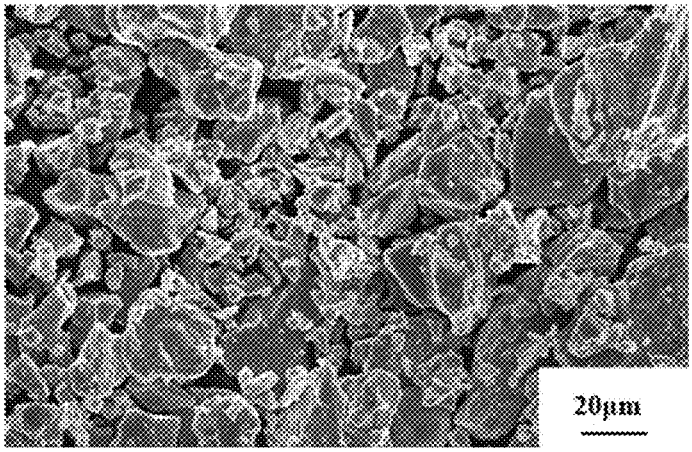
FIG. 1 is a scanning electron microscope picture of the morphology of HDH titanium powder in Example 1 of the present invention.

Hereinafter, exemplary embodiments of the present disclosure will be described in greater detail with reference to the accompanying drawings. Although the exemplary embodiments of the present disclosure are shown in the drawings, it should be understood that the present disclosure may be implemented in various forms and should not be limited by the embodiments set forth herein. On the contrary, these embodiments are provided to enable a more thorough understanding of the present disclosure and to fully convey the scope of the present disclosure to those skilled in the art.

The present invention discloses a method for preparing high-oxygen hydride-dehydride titanium powder by using a high-temperature rotary ball grinding treatment process. The method specifically includes:

S1-1: weighing hydride-dehydride titanium powder with a median diameter D50 of particle size being 15-50 μm and an oxygen content being ≤0.30 wt. % and zirconia grinding balls with a particle size being 6-8 mm, and putting the hydride-dehydride titanium powder and the grinding balls in a protective atmosphere tube furnace, with a mass ratio of the grinding balls to the hydride-dehydride titanium powder being 0.5-2:1.

S1-2: making the protective atmosphere tube furnace rotate at a speed of 10-60 r/min, and performing high-temperature rotary ball grinding treatment on the hydride-dehydride titanium powder in the tube furnace; in which the high-temperature rotary ball grinding treatment includes two stages; in a first treatment stage, the temperature is increased to 140-200° C. at a rate of 5-10° C./min in a mixed atmosphere of argon gas and oxygen gas with an oxygen volume fraction of 10-30 vol. %, and the temperature is held for 0.5-3 h; and in a second treatment stage, the temperature is increased to 450-600° C. at a rate of 5-10° C./min in an atmosphere of high-purity argon gas, and the temperature is held for 0.5-3 h.

S1-3: furnace cooling the hydride-dehydride titanium powder to room temperature after the high-temperature rotary ball grinding treatment, and sieving to obtain high-oxygen hydride-dehydride titanium powder with a particle size of 10-40 μm and an oxygen content of 0.8-1.5 wt. %.

The present invention also discloses a method for preparing high-purity ultra-fine $CaC_2/CaB_6$ powder by using the wet grinding method of high-energy vibration ball grinding treatment process. The method specifically includes:

S2-1: selecting a bulk $CaC_2/CaB_6$ raw material and zirconia grinding balls, and cutting and grinding the surface of the bulk $CaC_2/CaB_6$ raw material by using a small grinding device in an argon protective glove box, so as to remove a surface deteriorated portion; then loading the $CaC_2/CaB_6$ raw material and the zirconia grinding balls into a ball grinding tank in the argon protective glove box, and adding an anhydrous and oxygen-free volatile organic solvent to the ball grinding tank as a protective liquid to ensure that the ground $CaC_2/CaB_6$ raw material and grinding balls are completely immersed in the protective liquid; and then sealing the ball grinding tank and filling it with argon gas to keep a certain pressure in the ball grinding tank; in which a ball-to-material ratio of the zirconia grinding balls to the $CaC_2/CaB_6$ raw material is 5-10:1, and a diameter of the bulk $CaC_2/CaB_6$ raw material is usually 50-80 mm. The surface of the $CaC_2/CaB_6$ raw material deliquesces in the air, so a $Ca(OH)_2$ deterioration layer is attached, and the internal purity is greater than or equal to 99.9%; the oxygen content in the argon protective glove box is less than or equal to 0.1 ppm, and the water content is less than or equal to 0.1 ppm; and the anhydrous and oxygen-free volatile organic solvent includes at least one of aromatic hydrocarbons, aliphatic hydrocarbons, alicyclic hydrocarbons or halogenated hydrocarbons.

The aromatic hydrocarbons include at least one of benzene, toluene and xylene; the aliphatic hydrocarbons include at least one of n-pentane, n-hexane, n-heptane and n-octane; the alicyclic hydrocarbons include cyclohexane; and the halogenated hydrocarbons includes at least one of dichloromethane and trichloromethane.

S2-2: loading the ball grinding tank being sealed into a high-energy vibration ball grinding mill for wet grinding; in which a vibration frequency of the wet grinding is 1000-1400 times/min, and the wet grinding is performed for 3-6 h according to the ball grinding mode of ball grinding for 2-4 min and shutdown for 4-8 min, so as to obtain $CaC_2/CaB_6$ slurry.

S2-3: putting the ball grinding tank into the argon protective glove box for opening the tank or opening the tank under a vacuum condition, taking out the $CaC_2/CaB_6$ slurry obtained after wet grinding, drying it at 40-60° C. for 1-4 h, and then sieving to obtain high-purity ultra-fine $CaC_2/CaB_6$ powder with a purity ≥99.9% and a particle size ≤8 μm.

Figure 4:
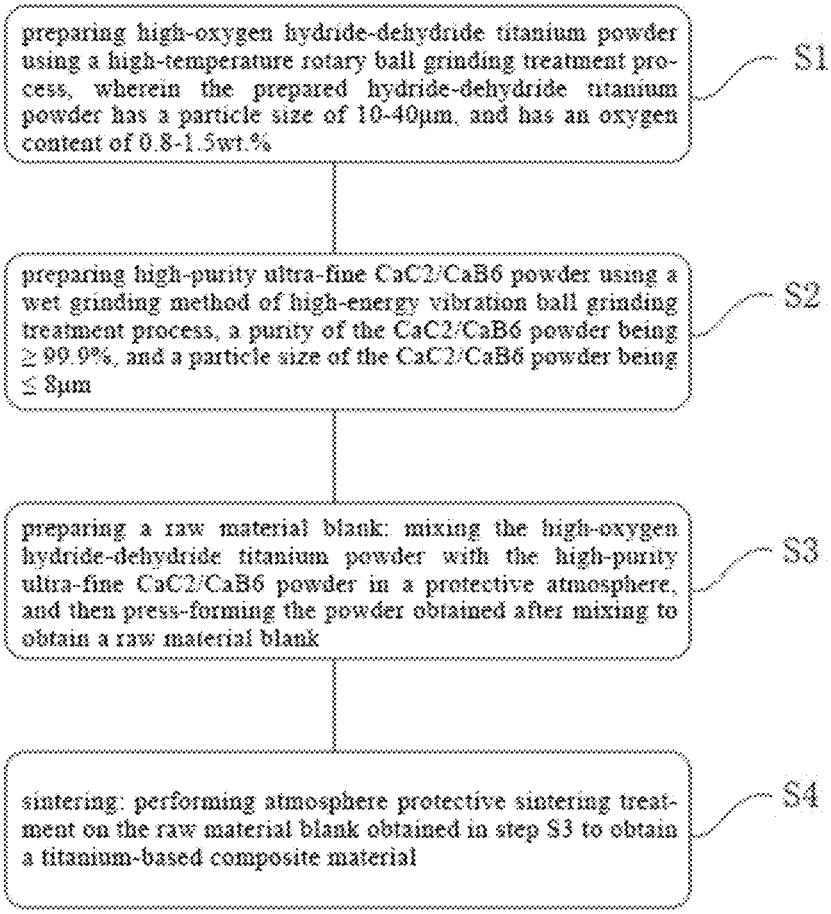
FIG. 4 is a flow chart of the preparation process of high-strength and high-plasticity titanium matrix composites in Examples of the present invention.

The present invention also discloses a method for preparing a high-strength and high-plasticity titanium matrix composite. As shown in FIG. 4, the method specifically includes the following steps:

S1: preparing high-oxygen hydride-dehydride titanium powder with a particle size of 10-40 μm and an oxygen content of 0.8-1.5 wt. % by using the above high-temperature rotary ball grinding treatment process.

S2: preparing high-purity ultra-fine $CaC_2/CaB_6$ powder with a purity ≥99.9% and a particle size ≤8 μm by using the above wet grinding method of high-energy vibration ball grinding treatment process.

S3: loading the high-oxygen hydride-dehydride titanium powder and the high-purity ultra-fine $CaC_2/CaB_6$ powder in an argon protective glove box, in which a mass fraction percentage of the $CaC_2/CaB_6$ powder is 0.4-2.0 wt. %;

sealing the powders; taking out the sealed powders; placing the sealed powders into a mechanical mixer, and mixing the sealed powders at a speed of 60-100 r/min for 4-8 h; and then pressing the powder obtained after mixing by mechanical one-way pressing, mechanical two-way pressing or cold isostatic pressing to obtain a raw material blank.

S4: sintering, in which the obtained raw material blank is sintered in hydrogen, argon or vacuum protective atmosphere, with a sintering temperature being 1100-1300° C., a heating rate being 2-8° C./min, and a temperature-holding time being 30-180 min, so as to obtain a titanium matrix composite.

The high-strength and high-plasticity titanium matrix composite and its preparation method will be described in detail below through specific Examples.

Example 1

HDH titanium powder with a median particle size of 40 μm and an oxygen content of 0.18 wt. % was used as raw material, a SEM morphology of which is shown in FIG. 1. The titanium powder raw material and zirconia grinding balls were mixed and loaded into a tubular quartz boat, with a mass ratio of the balls to the raw material being 1:1. The quartz boat was put into a rotary sintering furnace and was heated up to 160° C. at 5° C./min in an argon/oxygen mixed atmosphere (the oxygen volume fraction being 10 vol. %), and the temperature was held for 30 min. After the temperature-holding was completed, the atmosphere was changed to a pure argon protective atmosphere, and the temperature was increased to 450° C. at a heating rate of 5° C./min. The temperature was held for 60 min. After oxidation was completed, the HDH titanium powder with a median particle size of 35 μm and an oxygen content of 0.8 wt. % was obtained by sieving.

Figure 2:
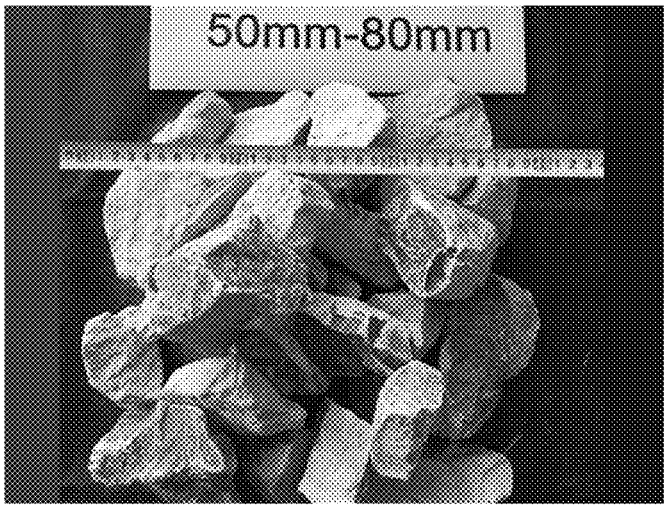
FIG. 2 is a physical picture of $CaC_2$ raw material in Example 1 of the present invention.
Figure 3:
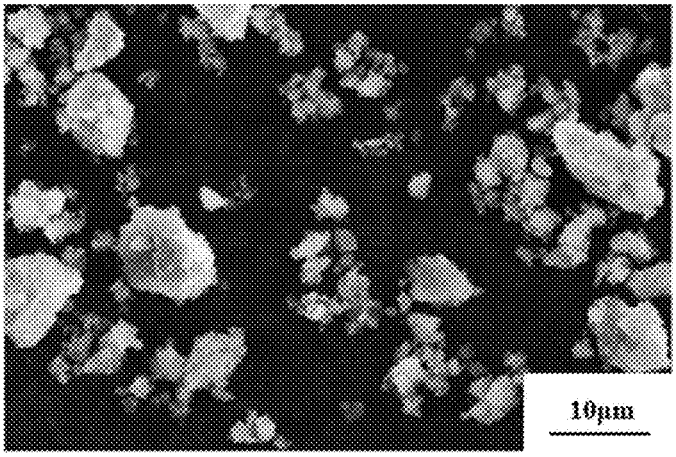
FIG. 3 is a scanning electron microscope picture of the morphology of $CaC_2$ powder after ball grinding in Example 1 of the present invention.

Subsequently, the $CaC_2$ with a median particle size of 50 mm was used as raw material, a SEM morphology of which was shown in FIG. 2. The surface of the bulk $CaC_2$ raw material was ground by using a small grinding device in an argon protective glove box to remove a surface deteriorated portion. Then, zirconia grinding balls and the ground high-purity bulk $CaC_2$ raw material were filled into a tank in the glove box with a ball-to-material ratio of 5:1. At the same time, n-hexane was added as a protective solvent. After filling, an argon gas was introduced into the tank so that there was a certain pressure in the ball grinding tank. After the above steps were completed, the filled ball grinding tank was put into a vibrating ball grinding mill for wet grinding, in which excitation frequency was 1400 times/min, and the wet grinding was performed for 4 h according to the ball grinding mode of ball grinding for 2 min and shutdown for 4 min. Then, the ball grinding tank was placed in the argon protective glove box for opening, and was dried at 40° C. for 1 h to obtain $CaC_2$ powder with a median particle size of about 3 μm, the SEM morphology of which was shown in FIG. 3.

Finally, the prepared HDH titanium powder was mixed with 0.6 wt. % $CaC_2$ powder on a mixer at a speed of 100 r/min for 4 h. After that, the composite powder was packed into a soft film envelope and cold isostatically pressed to form a raw material blank. Finally, the prepared raw material blank was put into a vacuum furnace for sintering, and the vacuum degree was $10^{-4}$ Pa. In the sintering process, the sintering temperature was 1300° C., the heating rate was 5° C./min, and the temperature-holding time was 120 min. Then, a titanium matrix composite part was obtained after furnace cooling to room temperature.

Example 2

HDH titanium powder with a median particle size of 35 μm and an oxygen content of 0.17 wt. % was used as raw material. The titanium powder raw material and zirconia grinding balls (with a particle size of 6-8 mm) were mixed and loaded into a tubular quartz boat, with a mass ratio of the balls to the raw material being 1.5:1. The quartz boat was put into a rotary sintering furnace and was heated up to 180° C. at 6° C./min in an argon/oxygen mixed atmosphere (the oxygen volume fraction being 20 vol. %), and the temperature was held for 1 h. After the temperature-holding was completed, the atmosphere was changed to a pure argon protective atmosphere, and the temperature was increased to 600° C. at a heating rate of 6° C./min. The temperature was held for 1.5 h. After oxidation was completed, HDH titanium powder with a median particle size of 30 μm and an oxygen content of 1.1 wt. % was obtained by sieving.

Subsequently, $CaC_2$ with a median particle size of 55 mm was used as raw material. The surface of the bulk $CaC_2$ raw material was ground by using a small grinding device in an argon protective glove box to remove a surface deteriorated portion. Then, zirconia grinding balls (with a particle size of 6-8 mm) and the ground high-purity bulk $CaC_2$ raw material were filled into a tank in the glove box with a ball-to-material ratio of 6:1. At the same time, dichloromethane was added as a protective solvent. After filling, an argon gas was introduced into the tank so that there was a certain pressure in the ball grinding tank. After the above steps were completed, the filled ball grinding tank was put into a vibrating ball grinding mill for wet grinding, in which a excitation frequency was 1300 times/min, and the wet grinding was performed for 3.5 h according to the ball grinding mode of ball grinding for 3 min and shutdown for 5 min. Then, the ball grinding tank was placed in the argon protective glove box for opening, and was dried at 45° C. for 1.5 h to obtain $CaC_2$ powder with a median particle size of about 5 μm.

Finally, the prepared HDH titanium powder was mixed with 1.1 wt. % $CaC_2$ powder on a mixer at a speed of 90 r/min for 5 h. After that, the composite powder was packed into a soft film envelope and pressed into a raw material blank through single-phase pressing. Finally, the prepared raw material blank was put into a vacuum furnace for sintering, and the vacuum degree was $10^{-3}$ Pa. In the sintering process, the sintering temperature was 1250° C., the heating rate was 6° C./min, and the temperature-holding time was 100 min. Then, a titanium matrix composite part was obtained after furnace cooling to room temperature.

Example 3

HDH titanium powder with a median particle size of 30 μm and an oxygen content of 0.15 wt. % was used as raw material. The titanium powder raw material and zirconia grinding balls (with a particle size of 6-8 mm) were mixed and loaded into a tubular quartz boat, with a mass ratio of the balls to the raw material being 2:1. The quartz boat was put into a rotary sintering furnace and was heated up to 200° C. at 8° C./min in an argon/oxygen mixed atmosphere (the oxygen volume fraction being 30 vol. %), and the temperature was held for 2 h. After the temperature-holding was completed, the atmosphere was changed to a pure argon protective atmosphere, and the temperature was increased to 600° C. at a heating rate of 8° C./min. The temperature was held for 2 h. After oxidation was completed, HDH titanium powder with a median particle size of 25 μm and an oxygen content of 1.5 wt. % was obtained by sieving.

Subsequently, $CaB_6$ with a median particle size of 60 mm was used as raw material. The surface of the bulk $CaB_6$ raw material was ground by using a small grinding device in an argon protective glove box to remove a surface deteriorated portion. Then, zirconia grinding balls (with a particle size of 6-8 mm) and the ground high-purity bulk $CaB_6$ raw material were filled into a tank in the glove box with a ball-to-material ratio of 8:1. At the same time, dichloromethane was added as a protective solvent. After filling, an argon gas was introduced into the tank so that there was a certain pressure in the ball grinding tank. After the above steps were completed, the filled ball grinding tank was put into a vibrating ball grinding mill for wet grinding, in which a excitation frequency was 1200 times/min, and the wet grinding was performed for 3 h according to the ball grinding mode of ball grinding for 3 min and shutdown for 6 min. Then, the ball grinding tank was placed in the argon protective glove box for opening, and was dried at 50° C. for 2 h to obtain $CaB_6$ powder with a median particle size of about 2 μm.

Finally, the prepared HDH titanium powder was mixed with 1.8 wt. % $CaB_6$ powder on a mixer at a speed of 80 r/min for 6 h. After that, the composite powder was packed into a soft film envelope and pressed into a raw material blank through single-phase pressing. Finally, the prepared raw material blank was put into a vacuum furnace for sintering, and the vacuum degree was $10^{-3}$ Pa. In the sintering process, the sintering temperature was 1200° C., the heating rate was 6° C./min, and the temperature-holding time was 90 min. Then, a titanium matrix composite part was obtained after furnace cooling to room temperature.

Example 4

HDH titanium powder with a median particle size of 20 μm and an oxygen content of 0.16 wt. % was used as raw material. The titanium powder raw material and zirconia grinding balls (with a particle size of 6-8 mm) were mixed and loaded into a tubular quartz boat, with a mass ratio of the balls to the raw material being 1.8:1. The quartz boat was put into a rotary sintering furnace and was heated up to 190° C. at 5° C./min in an argon/oxygen mixed atmosphere (the oxygen volume fraction being 25 vol. %), and the temperature was held for 1.5 h. After the temperature-holding was completed, the atmosphere was changed to a pure argon protective atmosphere, and the temperature was increased to 600° C. at a heating rate of 5° C./min. The temperature was held for 2 h. After oxidation was completed, HDH titanium powder with a median particle size of 20 μm and an oxygen content of 1.3 wt. % was obtained by sieving.

Subsequently, $CaC_2$ and $CaB_6$ with a median particle size of 58 mm were used as raw material. The surface of the bulk $CaC_2$ and $CaB_6$ raw material was ground by using a small grinding device in an argon protective glove box to remove a surface deteriorated portion. Then, zirconia grinding balls (with a particle size of 6-8 mm) and the ground high-purity bulk $CaC_2$ and $CaB_6$ raw material were filled into a tank in the glove box with a ball-to-material ratio of 7:1 (a mass ratio of $CaC_2$ to $CaB_6$ was 1:2). At the same time, dichloromethane was added as a protective solvent. After filling, an argon gas was introduced into the tank so that there was a certain pressure in the ball grinding tank. After the above steps were completed, the filled ball grinding tank was put into a vibrating ball grinding mill for wet grinding, in which a excitation frequency was 1300 times/min, and the wet grinding was performed for 4 h according to the ball grinding mode of ball grinding for 2 min and shutdown for 5 min. Then, the ball grinding tank was placed in the argon protective glove box for opening, and was dried at 45° C. for 2 h to obtain $CaC_2/CaB_6$ mixed powder with a median particle size of about 5 μm.

Finally, the prepared HDH titanium powder was mixed with 1.3 wt. % $CaC_2/CaB_6$ mixed powder (a mass ratio of $CaC_2$ to $CaB_6$ was 1:2) on a mixer at a speed of 100 r/min for 4 h. After that, the composite powder was packed into a soft film envelope and pressed into a raw material blank through single-phase pressing. Finally, the prepared raw material blank was put into a vacuum furnace for sintering, and the vacuum degree was $10^{-2}$ Pa. In the sintering process, the sintering temperature was 1200° C., the heating rate was 5° C./min, and the temperature-holding time was 120 min. Then, a titanium matrix composite part was obtained after furnace cooling to room temperature.

It can also be seen from the above Example 1 to Example 4 that the preparation of high-oxygen HDH titanium powder and high-purity ultra-fine $CaC_2/CaB_6$ oxygen adsorbent is the basis for increasing the content of multi-scale Ca—Ti—O, TiC, TiB reinforcing-phase particles. That is, the preparation of high-oxygen HDH titanium powder and the preparation of high-purity ultra-fine $CaC_2/CaB_6$ oxygen adsorbent complement each other, and synergistically play a role in the preparation of high-strength and high-plasticity titanium matrix composite.

In order to better illustrate the titanium matrix composite and its preparation process in the present invention, comparative experiments will be used in the following to describe the synergistic effect of high-oxygen HDH titanium powder and high-purity ultra-fine $CaC_2/CaB_6$ oxygen adsorbent in detail through specific comparative examples, and to describe specific range values of main parameters in the preparation processes of high-oxygen HDH titanium powder and high-purity ultra-fine $CaC_2/CaB_6$ oxygen adsorbent.

1. Experimental Objects

The experimental objects were the titanium matrix composites prepared in Examples 1-4 and the titanium matrix composites prepared in Comparative Examples 1-12, in which Comparative Examples 1-12 were divided into the following four groups:

(1) titanium powder raw materials using different preparation processes;
(2) different preparation processes of HDH titanium powder;
(3) different preparation processes of $CaC_2/CaB_6$ powder; and
(4) different preparation processes of HDH titanium powder and different preparation processes of $CaC_2/CaB_6$ powder.

2. Experimental Methods

Performances of the titanium matrix composites prepared in Examples 1-4 and Comparative Examples 1-12 were measured by using conventional detection methods in the prior art.

Performance Detection (1) Relative density test: the relative densities of the titanium matrix composites prepared in Examples 1-4 and Comparative Examples 1-12 were measured respectively.

(2) Mechanical property test: The room temperature tensile strengths and elongations of the titanium matrix composites prepared in Examples 1-4 and Comparative Examples 1-12 were measured respectively.

3. Test Results

The experimental results of Examples 1-4 and Comparative Examples 1-12 were summarized respectively.

(1) Titanium Powder Raw Materials Using Different Preparation Processes

Comparative Example 1

The aerosolized spherical titanium powder with a median particle size of 40 μm and an oxygen content of 0.17 wt. % was used as the raw material, and was made into a raw material blank. Subsequently, the prepared raw material blank was put into a vacuum furnace for sintering, and the vacuum degree and sintering process were the same as those in Example 1. Finally, a low-oxygen pure titanium sample was obtained.

The performances of the titanium matrix composites prepared by the preparation processes of Examples 1-4 and the low-oxygen pure titanium sample prepared by Comparative Example 1 were detected and summarized, as shown in Tables 1 and 2 below.

TABLE 1

| | Titanium matrix composite | | | | | | |
|---|---|---|---|---|---|---|---|
| Group | Microstructure | Grain size (μm) | Ca—Ti—O particle size (nm) | TiC/TiB particle size (μm) | Compactness (%) | Tensile strength (MPa) | Elongation (%) |
| Example 1 | micro-fine equiaxed grain | 80 | 200 | 3 | 98.2 | 820 | 26 |
| Example 2 | micro-fine equiaxed grain | 60 | 240 | 4 | 98.1 | 910 | 21 |
| Example 3 | micro-fine equiaxed grain | 40 | 300 | 4 | 98 | 980 | 18 |
| Example 4 | micro-fine equiaxed grain | 30 | 200 | 3 | 98.3 | 960 | 20 |

It can be seen from Table 1 that the titanium matrix composite prepared in the present invention has a micro-fine equiaxed grain microstructure, and the grain size is in a range of 40-80 μm. The titanium matrix composite has granular Ca—Ti—O reinforcing phase and TiC/TiB reinforcing phase, and there is an excellent bonding between the reinforcing-phase particles and the matrix interface. The size of Ca—Ti—O particles is in a range of 200-300 nm, the size of TiC/TiB particles is in a range of 3-4 μm, the material compactness is greater than or equal to 98.0%, the room temperature tensile strength is greater than or equal to 820 MPa, and the elongation is not less than 18%.

TABLE 2

| | | Raw | Part performance indexes | | |
|---|---|---|---|---|---|
| Group | Raw material powder | material cost (Yuan/kg) | Compactness (%) | Tensile strength (MPa) | Elongation (%) |
| Example 1 | HDH titanium powder (oxygen gas 10 vol. %) + 0.6 wt. % $CaC_2$ powder | 200~300 | 98.2 | 820 | 26 |
| Comparative Example 1 | aerosolized spherical titanium powder | 2000~2500 | 97.8 | 561 | 17 |

It can be seen from Table 2 that the titanium matrix composite prepared by using the low-cost hydride-dehydride titanium powder in the present invention not only has superior mechanical properties to the titanium alloy prepared by the commonly used aerosolized spherical titanium powder and meets the application requirements of the current stage, but also can greatly reduce the cost of raw material. The cost can be reduced by about 90%, so the present invention has broad application prospects.

(2) Different Preparation Processes of HDH Titanium Powder

Comparative Example 2

HDH titanium powder with a median particle size of 40 μm and an oxygen content of 0.18 wt. % was used as the raw material, and HDH titanium powder with a median particle size of 35 μm was obtained after sieving. According to the same method as that of Example 1, high-purity ultra-fine $CaC_2$ powder was prepared, and HDH titanium powder and $CaC_2$ powder were made into a raw material blank. Subsequently, the prepared raw material blank was put into a vacuum furnace for sintering, and the vacuum degree and sintering process were the same as those in Example 1. Finally, a low-oxygen pure titanium sample was obtained.

Comparative Example 3

HDH titanium powder with a median particle size of 40 μm and an oxygen content of 0.18 wt. % was used as the raw material. For the titanium powder and zirconia grinding balls (the particle size was 6-8 mm), according to the method of Example 1, the HDH titanium powder was subjected to high-temperature oxidation in a mixed atmosphere of argon gas and oxygen gas (the oxygen volume fraction was 5 vol. %), and was sieved to obtain HDH titanium powder with an oxygen content of 0.3 wt. % and a median particle size of 35 μm. According to the method of Example 1, high-purity ultra-fine $CaB_6$ powder was prepared, and the HDH titanium powder and $CaB_6$ powder were made into a raw material blank. Subsequently, the prepared raw material blank was put into a vacuum furnace for sintering, and the vacuum degree and sintering process were the same as those in Example 1. Finally, a high-oxygen pure titanium sample was obtained.

Comparative Example 4

HDH titanium powder with a median particle size of 40 μm and an oxygen content of 0.18 wt. % was used as the raw material. For the titanium powder and zirconia grinding balls (the particle size was 6-8 mm), according to the method of Example 1, the HDH titanium powder was subjected to high-temperature oxidation in a mixed atmosphere of argon gas and oxygen gas (the oxygen volume fraction was 40 vol. %), and was sieved to obtain HDH titanium powder with an oxygen content of 1.8 wt. % and a median particle size of 35 μm. According to the method of Example 1, high-purity ultra-fine $CaC_2$ powder was prepared, and the HDH titanium powder and $CaC_2$ powder were made into a raw material blank. Subsequently, the prepared raw material blank was put into a vacuum furnace for sintering, and the vacuum degree and sintering process were the same as those in Example 1. Finally, a high-oxygen pure titanium sample was obtained.

The performances of the titanium matrix composite prepared by the preparation process of Example 1 and the pure titanium samples prepared by Comparative Examples 2-4 were detected and summarized, as shown in Table 3 below.

TABLE 3

| Group | Raw material powder | Raw material cost (Yuan/kg) | Part performance indexes: Compactness (%) | Tensile strength (MPa) | Elongation (%) |
|---|---|---|---|---|---|
| Example 1 | HDH titanium powder (oxygen gas 10 vol. %) + 0.6 wt. % $CaC_2$ powder | 200~300 | 98.2 | 820 | 26 |
| Comparative Example 2 | HDH titanium powder (not prepared by high-temperature oxidation) + 0.6 wt. % $CaC_2$ powder | 200~300 | 97.2 | 532 | 11 |
| Comparative Example 3 | HDH titanium powder (oxygen gas 5 vol. %) + 0.6 wt. % $CaB_6$ powder | 200~300 | 96.4 | 622 | 13 |
| Comparative Example 4 | HDH titanium powder (oxygen gas 40 vol. %) + 0.6 wt. % $CaC_2$ powder | 200~300 | 93.5 | 760 | 3.5 |

It can be seen from Table 3 that the titanium matrix composite prepared in the present invention has excellent mechanical properties, in which the oxygen volume fraction of the argon/oxygen mixed gas in the high-temperature rotary ball grinding process is 10-30 vol. %. If the oxygen volume fraction is low, the oxygen content of HDH titanium powder will be low (<10 vol. %), which makes it difficult for the $CaC_2/CaB_6$ powder to react completely, so that the material properties will be deteriorated; and if the oxygen volume fraction is high (>30 vol. %), the oxygen content of HDH titanium powder will be high, which makes it difficult for the oxygen in the powder to be completely adsorbed, so that they will be solid-dissolved in the matrix, which also deteriorates the material properties. Therefore, the oxygen content of HDH titanium powder should be controlled within a certain range and can completely react with the high-purity ultra-fine $CaC_2/CaB_6$ powder, so that a titanium matrix composite with excellent comprehensive mechanical properties can be prepared.

(3) Different Preparation Processes of $CaC_2/CaB_6$ Powder

Comparative Example 5

HDH titanium powder with a median particle size of 40 μm and an oxygen content of 0.18 wt. % was used as the raw material. For the titanium powder and zirconia grinding balls (the particle size was 6-8 mm), according to the method of Example 1, the HDH titanium powder was subjected to high-temperature oxidation in a mixed atmosphere of argon gas and oxygen gas (the oxygen volume fraction was 10 vol. %), and was sieved to obtain HDH titanium powder with an oxygen content of 0.8 wt. % and a median particle size of 35 μm. The HDH titanium powder was made into a raw material blank according to the method of Example 1, except that no $CaC_2$ powder was added. Subsequently, the prepared raw material blank was put into a vacuum furnace for sintering, and the vacuum degree and sintering process were the same as those in Example 1. Finally, a high-oxygen pure titanium sample was obtained.

Comparative Example 6

HDH titanium powder with a median particle size of 40 μm and an oxygen content of 0.18 wt. % was used as the raw material. For the titanium powder and zirconia grinding balls (the particle size was 6-8 mm), according to the method of Example 1, the HDH titanium powder was subjected to high-temperature oxidation in a mixed atmosphere of argon gas and oxygen gas (the oxygen volume fraction was 30 vol. %), and was sieved to obtain HDH titanium powder with an oxygen content of 1.5 wt. % and a median particle size of 35 μm. The HDH titanium powder was made into a raw material blank according to the method of Example 1, except that no $CaC_2$ powder was added. Subsequently, the prepared raw material blank was put into a vacuum furnace for sintering, and the vacuum degree and sintering process are the same as those in Example 1. Finally, a high-oxygen pure titanium sample was obtained.

Comparative Example 7

HDH titanium powder with a median particle size of 40 μm and an oxygen content of 0.18 wt. % was used as the raw material. For the titanium powder and zirconia grinding balls (the particle size was 6-8 mm), according to the method of Example 1, the HDH titanium powder was subjected to high-temperature oxidation in a mixed atmosphere of argon gas and oxygen gas (the oxygen volume fraction was 10 vol. %), and was sieved to obtain HDH titanium powder with an oxygen content of 0.8 wt. % and a median particle size of 35 μm. The $CaC_2$ raw material with a median particle size of 50 mm was directly loaded into a ball grinding tank for high-energy vibration ball grinding to obtain $CaC_2$ powder, and after sieving, ultra-fine $CaC_2$ powder with a median particle size of 3 μm was obtained. Finally, according to the method of Example 1, the HDH titanium powder (the oxygen volume fraction in the mixed gas during oxidation was 10 vol. %) and 0.6 wt. % $CaC_2$ powder were mixed, pressed into a raw material blank, and then sintered to finally obtain a high-oxygen titanium matrix composite sample.

Comparative Example 8

HDH titanium powder with a median particle size of 40 μm and an oxygen content of 0.18 wt. % was used as the raw material. For the titanium powder and zirconia grinding balls (the particle size was 6-8 mm), according to the method of Example 1, the HDH titanium powder was subjected to high-temperature oxidation in a mixed atmosphere of argon gas and oxygen gas (the oxygen volume fraction was 10 vol. %), and was sieved to obtain HDH titanium powder with an oxygen content of 0.8 wt. % and a median particle size of 35 μm. $CaB_6$ powder with a median particle size of about 3 μm was prepared according to the method of Example 1. Finally, according to the method of Example 1, the HDH titanium powder (the oxygen volume fraction in the mixed gas during oxidation was 10 vol. %) and 0.3 wt. % $CaB_6$ powder were mixed, pressed into a raw material blank, and then sintered to finally obtain a high-oxygen titanium matrix composite sample.

Comparative Example 9

HDH titanium powder with a median particle size of 40 μm and an oxygen content of 0.18 wt. % was used as the raw material. For the titanium powder and zirconia grinding balls (the particle size was 6-8 mm), according to the method of Example 1, the HDH titanium powder was subjected to high-temperature oxidation in a mixed atmosphere of argon gas and oxygen gas (the oxygen volume fraction was 10 vol. %), and was sieved to obtain HDH titanium powder with an oxygen content of 0.8 wt. % R and a median particle size of 35 nm. $CaC_2$ powder with a median particle size of about 3 μm was prepared according to the method of Example 1. Finally, according to the method of Example 1, the HDH titanium powder (the oxygen volume fraction in the mixed gas during oxidation was 10 vol. %) and 2.4 wt. % $CaC_2$ powder were mixed, pressed into a raw material blank, and then sintered to finally obtain a high-oxygen titanium matrix composite sample.

The performances of the titanium matrix composite prepared by the preparation process of Example 1 and the pure titanium samples prepared by Comparative Examples 5-9 were detected and summarized, as shown in Table 4 below.

TABLE 4

| Group | Raw material powder | Raw material cost (Yuan/kg) | Part performance indexes: Compactness (%) | Tensile strength (MPa) | Elongation (%) |
|---|---|---|---|---|---|
| Example 1 | HDH titanium powder (oxygen gas 10 vol. %) + 0.6 wt. % $CaC_2$ powder | 200~300 | 98.2 | 820 | 26 |
| Comparative Example 5 | HDH titanium powder (oxygen gas 10 vol. %) (without $CaC_2$ powder added) | 200~300 | 95.2 | 602 | 5.5 |
| Comparative Example 6 | HDH titanium powder (oxygen gas 30 vol. %) (without $CaC_2$ powder added) | 200~300 | 94.6 | 667 | 1.2 |
| Comparative Example 7 | HDH titanium powder (oxygen gas 10 vol. %) + 0.6 wt. % $CaC_2$ (ball grinding without isolation protection) | 200~300 | 93.8 | 612 | brittle fracture |
| Comparative Example 8 | HDH titanium powder (oxygen gas 10 vol. %) + 0.3 wt. % $CaB_6$ powder | 200~300 | 95.8 | 720 | 12 |
| Comparative Example 9 | HDH titanium powder (oxygen gas 10 vol. %) + 2.4 wt. % $CaC_2$ powder | 200~300 | 97.3 | 757 | 6 |

It can be seen from Table 4 that the method of Example 1 of the present invention can prepare a titanium matrix composite with low cost and excellent mechanical properties. It can be seen from Comparative Examples 5-6 that if the high-purity ultra-fine $CaC_2$ powder is not introduced, when the oxygen content of the HDH titanium powder is high, although the tensile strength is slightly increased, the plasticity deteriorates seriously. It can be seen from the Comparative Example 7 that the $CaC_2$ powder prepared without the protection of the method of Example 1 is prone to moisture absorption and hydrolysis, and if it is introduced, it cannot play the role of adsorbing and fixing oxygen, and it will agglomerate in the matrix, which will seriously deteriorate the performances of the material. It can be seen from Comparative Examples 8-9 that the addition amount of high-purity ultra-fine $CaC_2/CaB_6$ powder should be controlled within a certain range (0.4-2.0 wt. %), and too much or too little high-purity ultra-fine $CaC_2/CaB_6$ powder will lead to deterioration of the mechanical properties of the material.

(4) Different Preparation Processes of HDH Titanium Powder and Different Preparation Processes of $CaC_2/CaB_6$ Powder Comparative Example 10

HDH titanium powder with a median particle size of 40 μm and an oxygen content of 0.18 wt. % was used as the raw material. For the titanium powder and zirconia grinding balls (the particle size was 6-8 mm), according to the method of Example 1, the HDH titanium powder was subjected to high-temperature oxidation in a mixed atmosphere of argon gas and oxygen gas (the oxygen volume fraction was 5 vol. %), and was sieved to obtain HDH titanium powder with an oxygen content of 0.3 wt. % and a median particle size of 35 μm. $CaB_6$ powder with a median particle size of about 3 μm was prepared according to the method of Example 1. Finally, according to the method of Example 1, the HDH titanium powder (the oxygen volume fraction in the mixed gas during oxidation was 5 vol. %) and 0.3 wt. % $CaB_6$ powder were mixed, pressed into a raw material blank, and then sintered to finally obtain a high-oxygen titanium matrix composite sample.

Comparative Example 11

HDH titanium powder with a median particle size of 40 μm and an oxygen content of 0.18 wt. % was used as the raw material. For the titanium powder and zirconia grinding balls (the particle size was 6-8 mm), according to the method of Example 1, the HDH titanium powder was subjected to high-temperature oxidation in a mixed atmosphere of argon gas and oxygen gas (the oxygen volume fraction was 40 vol. %), and was sieved to obtain HDH titanium powder with an oxygen content of 1.8 wt. % and a median particle size of 35 μm. $CaC_2$ powder with a median particle size of about 3 μm was prepared according to the method of Example 1. Finally, according to the method of Example 1, the HDH titanium powder (the oxygen volume fraction in the mixed gas during oxidation was 40 vol. %) and 2.4 wt. % $CaC_2$ powder were mixed, pressed into a raw material blank, and then sintered to finally obtain a high-oxygen titanium matrix composite sample.

Comparative Example 12

HDH titanium powder with a median particle size of 40 μm and an oxygen content of 0.18 wt. % was used as the raw material, and HDH titanium powder with a median particle size of 35 μm was obtained after sieving. The $CaC_2$ raw material with a median particle size of 50 mm was directly loaded into a ball grinding tank for high-energy vibration ball grinding to obtain $CaC_2$ powder, and after sieving, ultra-fine $CaC_2$ powder with a median particle size of 3 μm was obtained. According to the method of Example 1, the HDH titanium powder and $CaC_2$ powder were made into a raw material blank. Subsequently, the prepared raw material blank was put into a vacuum furnace for sintering, and the vacuum degree and sintering process are the same as those in Example 1. Finally, a low-oxygen pure titanium sample was obtained.

The performances of the titanium matrix composite prepared by the preparation process of Example 1 and the pure titanium samples prepared by Comparative Examples 10-12 were detected and summarized, as shown in Table 5 below.

TABLE 5

| Group | Raw material powder | Raw material cost (Yuan/kg) | Compactness (%) | Part performance indexes: Tensile strength (MPa) | Part performance indexes: Elongation (%) |
|---|---|---|---|---|---|
| Example 1 | HDH titanium powder (oxygen gas 10 vol. %) + 0.6 wt. % $CaC_2$ powder | 200~300 | 98.2 | 820 | 26 |
| Comparative Example 10 | HDH titanium powder (oxygen gas 5 vol. %) + 0.3 wt. % $CaB_6$ powder | 200~300 | 97.0 | 603 | 15 |
| Comparative Example 11 | HDH titanium powder (oxygen gas 40 vol. %) + 2.4 wt. % $CaC_2$ powder | 200~300 | 93.2 | 902 | 1.5 |
| Comparative Example 12 | HDH titanium powder (not prepared by high-temperature oxidation) + 0.6 wt. % $CaC_2$ (ball grinding without isolation protection) | 200~300 | 91.3 | 495 | brittle fracture |

It can be concluded from Table 5 that the titanium matrix composite prepared in the present invention has excellent mechanical properties. It can be seen from Comparative Examples 10-11 that the oxygen volume fraction of the argon/oxygen mixed gas in the high-temperature rotary ball grinding process and the addition amount of the high-purity ultra-fine $CaC_2/CaB_6$ powder need to be organically coordinated so that a titanium matrix composite with excellent comprehensive mechanical properties can be prepared. It can be seen from Comparative Example 12 that if the high-oxygen HDH titanium powder and $CaC_2/CaB_6$ powder are not prepared according to the method of Example 1, the prepared titanium matrix composite will have poor mechanical properties and will be prone to brittle fracture.

Described above are only preferred specific embodiments of the present invention, but the scope of protection of the present invention is not limited thereto. Any change or replacement that can be easily conceived by those skilled in the art within the technical scope disclosed in the present invention shall be covered within the scope of protection of the present invention. Therefore, the scope of protection of the present invention shall be subject to the scope of protection of the claims.

The invention claimed is:

1. A method for preparing a high-strength and high-plasticity titanium matrix composite, comprising the following steps:

S1: preparing high-oxygen hydride-dehydride titanium powder using a high-temperature rotary ball grinding treatment process, wherein the prepared hydride-dehydride titanium powder has a particle size of 10-40 μm, and has an oxygen content of 0.8-1.5 wt. %;

S2: preparing high-purity ultra-fine oxygen adsorbent powder using a wet grinding method of high-energy vibration ball grinding treatment process; wherein a purity of the oxygen adsorbent powder is ≥99.9%, and a particle size of the oxygen adsorbent powder is ≤8 μm; and the oxygen adsorbent is selected from at least one of CaC2 and CaB6;

S3: preparing a raw material blank, wherein the high-oxygen hydride-dehydride titanium powder is mixed with the high-purity ultra-fine oxygen adsorbent powder in a protective atmosphere, and then the powder obtained after mixing is press-formed to obtain a raw material blank; and S4: sintering, wherein the raw material blank obtained in step S3 is subjected to atmosphere protective sintering treatment to obtain a titanium matrix composite.

2. The method for preparing the high-strength and high-plasticity titanium matrix composite according to claim 1, wherein in step S1, the high-temperature rotary ball grinding treatment process comprises:

S1-1: putting the hydride-dehydride titanium powder and grinding balls into a protective atmosphere furnace;

S1-2: performing high-temperature rotary ball grinding treatment on the hydride-dehydride titanium powder in the protective atmosphere furnace, wherein a rotational speed of rotary ball grinding in this step is 10-60 r/min; and S1-3: cooling the hydride-dehydride titanium powder treated in step S1-2 to room temperature, and sieving to obtain high-oxygen hydride-dehydride titanium powder.

3. The method for preparing the high-strength and high-plasticity titanium matrix composite according to claim 2, wherein in step S1-1, the hydride-dehydride titanium powder has a median diameter D50 of the particle size of 15-50 μm, and has an oxygen content of ≤0.30 wt. %.

4. The method for preparing the high-strength and high-plasticity titanium matrix composite according to claim 2, wherein in step S1-2, the high-temperature rotary ball grinding treatment comprises two stages; wherein in a first treatment stage, the temperature is increased to 140-200° C. at a rate of 5-10° C./min in a mixed atmosphere of argon gas and oxygen gas with an oxygen volume fraction of 10-30 vol. %, and the temperature is held for 0.5-3 h; and in a second treatment stage, the temperature is increased to 450-600° C. at a rate of 5-10° C./min in an atmosphere of high-purity argon gas, and the temperature is held for 0.5-3 h.

5. The method for preparing the high-strength and high-plasticity titanium matrix composite according to claim 1, wherein in step S2, the wet grinding method of high-energy vibration ball grinding treatment process comprises:

S2-1: loading the oxygen adsorbent raw material and zirconia grinding balls into a ball grinding tank in a protective atmosphere, adding a protective liquid to the ball grinding tank, and then sealing the ball grinding tank;

S2-2: loading the sealed ball grinding tank into a high-energy vibration ball grinding mill for wet grinding to obtain an oxygen adsorbent slurry; and S2-3: drying the oxygen adsorbent slurry obtained after wet grinding under a protective atmosphere condition or vacuum condition at 40-60° C. for 1-4 h, and then sieving to obtain high-purity ultra-fine oxygen adsorbent powder.

6. The method for preparing the high-strength and high-plasticity titanium matrix composite according to claim 5, wherein in step S2-1, a ball-to-material ratio of the zirconia grinding balls to the oxygen adsorbent raw material is 5-10:1, and the protective liquid is an anhydrous and oxygen-free volatile organic solvent.

7. The method for preparing the high-strength and high-plasticity titanium matrix composite according to claim 5, wherein in step S2-2, a vibration frequency of the wet grinding is 1000-1400 times/min, and the wet grinding is performed for 3-6 h according to the ball grinding mode of ball grinding for 2-4 min and shutdown for 4-8 min.

8. The method for preparing the high-strength and high-plasticity titanium matrix composite according to claim 1, wherein in step S3, a mass fraction percentage of the oxygen adsorbent powder during mixing is 0.4-2.0 wt. %.

9. The method for preparing the high-strength and high-plasticity titanium matrix composite according to claim 1, wherein in step S4, a sintering temperature of the sintering treatment is 1100-1300° C., a heating rate is 2-8° C./min, and a temperature-holding time is 30-180 min.

10. A high-strength and high-plasticity titanium matrix composite, which is prepared by the method according to claim 1, wherein the titanium matrix composite has a micro-fine equiaxed grain microstructure, with a grain size being 20-100 μm.

11. The method for preparing the high-strength and high-plasticity titanium matrix composite according to claim 2, wherein in step S2, the wet grinding method of high-energy vibration ball grinding treatment process comprises:

S2-1: loading the oxygen adsorbent raw material and zirconia grinding balls into a ball grinding tank in a protective atmosphere, adding a protective liquid to the ball grinding tank, and then sealing the ball grinding tank;

S2-2: loading the sealed ball grinding tank into a high-energy vibration ball grinding mill for wet grinding to obtain an oxygen adsorbent slurry; and S2-3: drying the oxygen adsorbent slurry obtained after wet grinding under a protective atmosphere condition or vacuum condition at 40-60° C. for 1-4 h, and then sieving to obtain high-purity ultra-fine oxygen adsorbent powder.

12. The method for preparing the high-strength and high-plasticity titanium matrix composite according to claim 3, wherein the grinding balls are zirconia with a particle size of 6-8 mm; and a mass ratio of the grinding balls to the hydride-dehydride titanium powder is 0.5-2:1.

13. The method for preparing the high-strength and high-plasticity titanium matrix composite according to claim 8, wherein the mixing is carried out on a mechanical mixer, a rotational speed of the mixer is 60-100 r/min, and the time is 4-8 h.

14. The high-strength and high-plasticity titanium matrix composite according to claim 10, wherein a granular Ca—Ti—O reinforcing phase and TiC, TiB reinforcing phase are generated in-situ in the titanium matrix composite, with a particle size of the Ca—Ti—O reinforcing phase being 100-300 nm, and a particle size of the TIC, TiB reinforcing phase being 1-5 μm.

* * * * *